US007677985B1

(12) United States Patent
Tsai

(10) Patent No.: US 7,677,985 B1
(45) Date of Patent: Mar. 16, 2010

(54) CUE STICK

(76) Inventor: Po-Wen Tsai, 1F, No. 676, Jhongming South Rd., Taichung City 402 (TW)

( * ) Notice: Subject to any disclaimer, the term of this patent is extended or adjusted under 35 U.S.C. 154(b) by 0 days.

(21) Appl. No.: 12/230,002

(22) Filed: Aug. 21, 2008

(51) Int. Cl.
*A63D 15/08* (2006.01)

(52) U.S. Cl. ..... 473/44

(58) Field of Classification Search ..... 473/44–51
See application file for complete search history.

(56) References Cited

U.S. PATENT DOCUMENTS

| | | | | |
|---|---|---|---|---|
| 1,007,668 | A * | 11/1911 | Barrows | 473/44 |
| 1,702,292 | A * | 2/1929 | Barrett | 473/44 |
| 5,749,788 | A * | 5/1998 | Bourque | 473/44 |
| 2002/0132677 | A1* | 9/2002 | Chang | 473/44 |
| 2003/0153393 | A1* | 8/2003 | Chang | 473/44 |
| 2006/0160633 | A1* | 7/2006 | Tsai | 473/44 |
| 2007/0010340 | A1* | 1/2007 | Miki | 473/44 |
| 2007/0060407 | A1* | 3/2007 | Chang | 473/44 |
| 2009/0048032 | A1* | 2/2009 | Chang | 473/44 |

* cited by examiner

*Primary Examiner*—Mark S Graham
(74) *Attorney, Agent, or Firm*—Rosenberg, Klein & Lee

(57) ABSTRACT

A cue stick includes a shaft, a solid force-transmitting pipe, a butt, and a wooden fitting portion. This shaft includes a tip, a solid portion, a hollow portion and a connecting portion. This solid force-transmitting pipe contains an inner space. The butt connects with the shaft. The wooden fitting portion fills in the inner space. The density of the wooden fitting portion is between 80% and 120% of the density of the solid portion. So, the weight and size are nearly same as the ones of a traditional solid wood cue stick. The total weight of the cue stick is proper. Its internal force transmission is evenly distributed. Plus, the feedback feeling for striking the cue ball is excellent.

4 Claims, 3 Drawing Sheets

CUE STICK

BACKGROUND OF THE INVENTION

1. Field of the Invention

The present invention relates to a cue stick. Particularly, it relates to a cue stick having a solid force-transmitting pipe and a wooden fitting portion. In which, the weight and size are nearly same as the ones of a traditional solid wood cue stick. The total weight of the cue stick is proper. Its internal force transmission is evenly distributed. Plus, the feedback feeling for striking the cue ball is excellent.

2. Description of the Prior Art

FIG. 1 is an exploded view showing a first traditional cue stick 70. It includes a shaft 71 and a butt 72. This shaft 71 contains a thread hole 711. The butt 72 has a threaded portion 721. So, the shaft 71 and the butt 72 can be connected together as a long stick. Because the shaft 71 and the butt 72 are made by wood, there are many tiny internal gaps and spaces (not shown) in the wood. When a player uses a brand new cue stick 70, by repeated striking the cue balls, the internal gaps and spaces of this cue stick 70 will be compressed gradually. After using a period of time, most internal gaps and spaces are compressed into a stable condition (almost reaching its limit and it cannot be compressed anymore). Under such circumstances, when the player strikes the cue ball, this person has a feeling of consistency. The feeling of consistency can be explained and defined as below. Assuming the hand of this player applies a hitting force of 100 units. The cue stick 70 only absorbs 1 to 2 units. So, the force transmitted to the cue ball is very close to the ideal condition. At this moment, the control for striking a cue ball is accurate and stable. However, based on the experiences of most professional players, it usually needs several weeks or even several months to obtain such feeling (that is the feeling of consistency) depending on different players and different cue stick materials. However, if a buyer has to spend such a long period of time to obtain the feeling of consistency for a new cue stick, it takes too much time. It significantly reduces the willing for buying a new cue stick.

In order to reduce the above-mention time, a second traditional cue stick 80 appears in the market of cue sticks. Referring to FIG. 2, the second traditional cue stick 80 comprises a shaft 81 and a butt 82. The shaft 81 has a tip 811, a solid portion 812 (having a first length L1), a hollow portion 813 (having a second length L2) and a connecting portion 814. This hollow portion 813 has a deep hole 815 for receiving a hollow solid force-transmission portion 83. This hollow solid force-transmission portion 83 has an inner cylindrical space 84. When the player applies a hitting force F, this hitting force F passes through both the hollow solid force-transmission portion 83 (indicated by a first component force F1 as shown in FIG. 2) and the hollow portion 813 (indicated by a second component force F2 as shown in FIG. 2) and finally through the solid portion 812 as well as the tip 811. Nevertheless, it still has the following problems and disadvantages.

[1] The balance point of the cur stick moves back. Although the force transmission of the second traditional cue stick 80 is better than the first traditional cue stick 70, the second traditional cue stick 80 contains an inner cylindrical space 842. It makes the weight of the shaft 81 lighter. The balance point of this second traditional cue stick 80 moves back. Because of this change, the holding position has to be changed accordingly. It will influence the feeling of holding the second traditional cue stick 80 that the player has gotten used to.

Also, it might cause the hitting force cannot be accurately controlled. Anyway, the striking feeling becomes odd for this player.

[2] The weight of the cue stick becomes lighter. The air fills in the inner cylindrical space 842, so the total weight of the second traditional cue stick 80 becomes lighter. Hence, the inertial force of the second traditional cue stick 80 becomes smaller. It also means the dynamic energy for making the cue ball moving becomes smaller. Therefore, it will cause the moving path shorter (assuming the cue ball should move from the first position P1 to the second position P2, but it only arrives the third position P3, as illustrated in FIG. 3). Besides, it will reduce the rotational energy (while striking with side-spin) so that the moving path deviates (such as the directions V1 or V2 shown by the dotted lined in FIG. 3). Even though it is just a small difference, it could make the player loose the game.

[3] Its force transmission is not evenly distributed. Due to the existence of this inner cylindrical space 842, the force will transmit through the hollow portion 813 and the hollow solid force-transmission portion 83. Therefore, its force transmission is not evenly distributed.

SUMMARY OF THE INVENTION

The primary object of the present invention is to provide a cue stick. The weight and size of this invention are nearly same as the ones of a traditional solid wood cue stick.

The next object of the present invention is to provide a cue stick. In which, the total weight of the cue stick is proper.

The other object of the present invention is to provide a cue stick. Its internal force transmission is evenly distributed.

Another object of the present invention is to provide a cue stick. In which, the feedback feeling for striking the cue ball is excellent.

DETAILED DESCRIPTION OF THE INVENTION

Figure 1:
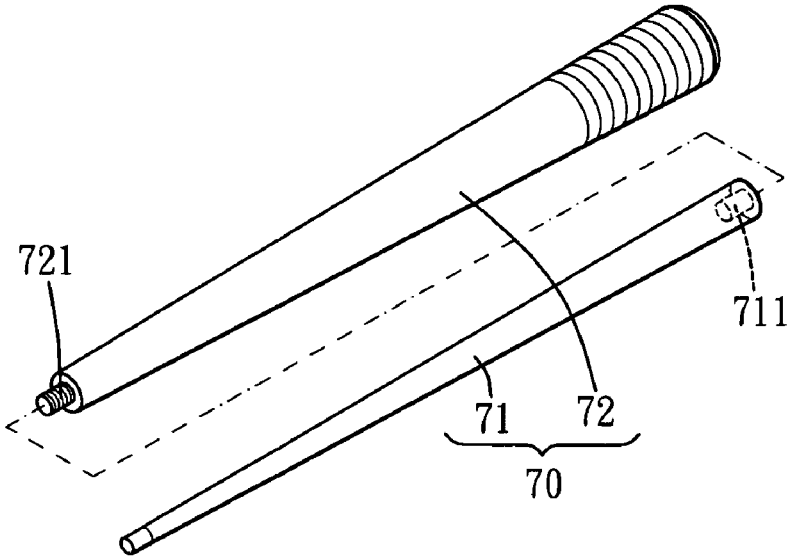
FIG. 1 (PRIOR ART)
FIG. 1 is an exploded view showing a first traditional cue stick.
Figure 2:
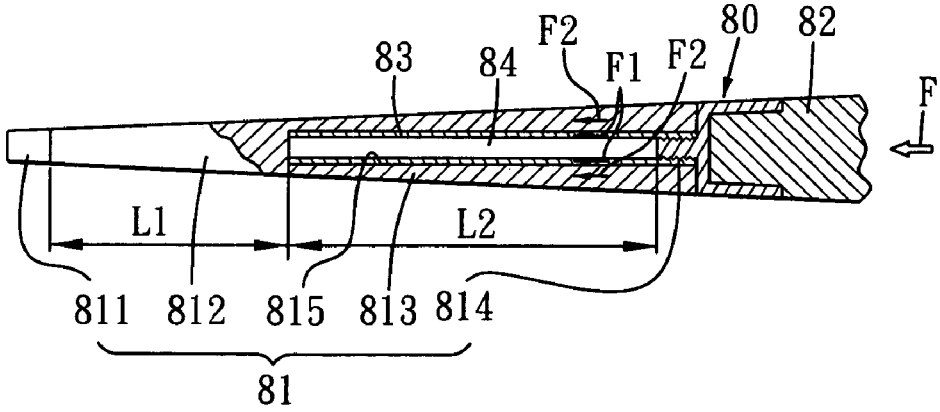
FIG. 2 (PRIOR ART)
FIG. 2 is a partially cross-sectional view illustrating the inner structure of a second traditional cur stick.
Figure 3:
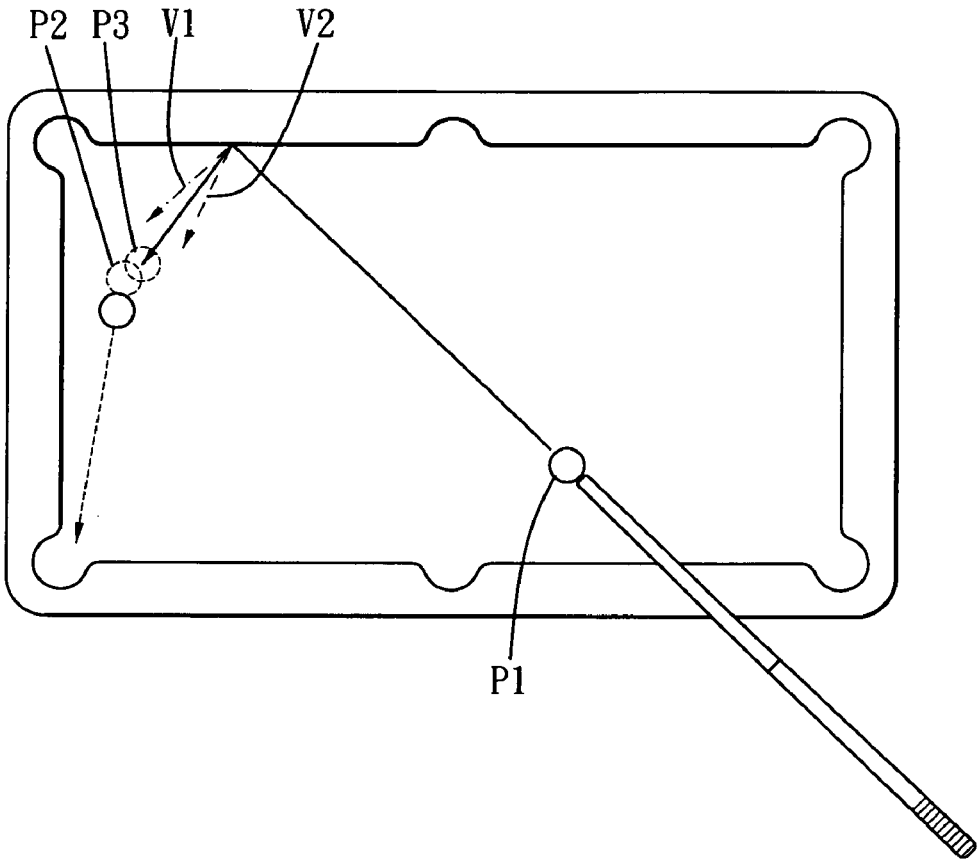
FIG. 3 (PRIOR ART)
FIG. 3 is a view of the second traditional cur stick that strike a cue ball.

The present invention is a cue stick. It mainly comprises a shaft 10, a solid force-transmitting pipe 20, a butt 30, and a wooden fitting portion 40.

Concerning this shaft 10, it includes a tip 11, a solid portion 12, a hollow portion 13 and a connecting portion 14 in sequence. The solid portion 12 has a first length L1. The hollow portion 13 has a deep hole 131.

With regard to this solid force-transmitting pipe 20, it is disposed in the deep hole 131. This solid force-transmitting pipe has a second length L2 and an inner space 21. The solid force-transmitting pipe 20 has two ends. One end of the solid force-transmitting pipe 20 connects with the solid portion 12. Preferably, this solid force-transmitting pipe 20 is selected from carbon fiber or fiberglass.

About this butt 30, it has an engaging element 31 for connecting with the connecting portion 14 of the shaft 10. This engaging element 31 contacts with the other end of the solid force-transmitting pipe 20.

Furthermore, the wooden fitting portion 40 is disposed in the inner space 21 (substantially fills in fully). This wooden fitting portion 40 has a first density. The solid portion 12 has a second density. The first density of the wooden fitting portion 40 is between 80% and 120% of the second density of the solid portion 12. For example, both the wooden fitting portion 40 and the solid portion 12 are maples. Or, both of them are aspens (or the like). Under this condition, they have the same density (or very close). However, they might be two different woods. Or, the first density slightly differs from the second density, such as the first density of the wooden fitting portion 40 is 0.52 (g/cm$^3$) and the second density of the solid portion 12 is 0.47 (g/cm$^3$). In this case, the first density of the wooden fitting portion 40 is approximately 110.6% of the second density of the solid portion 12. Generally, it is acceptable that their densities are close.

Figure 4A:
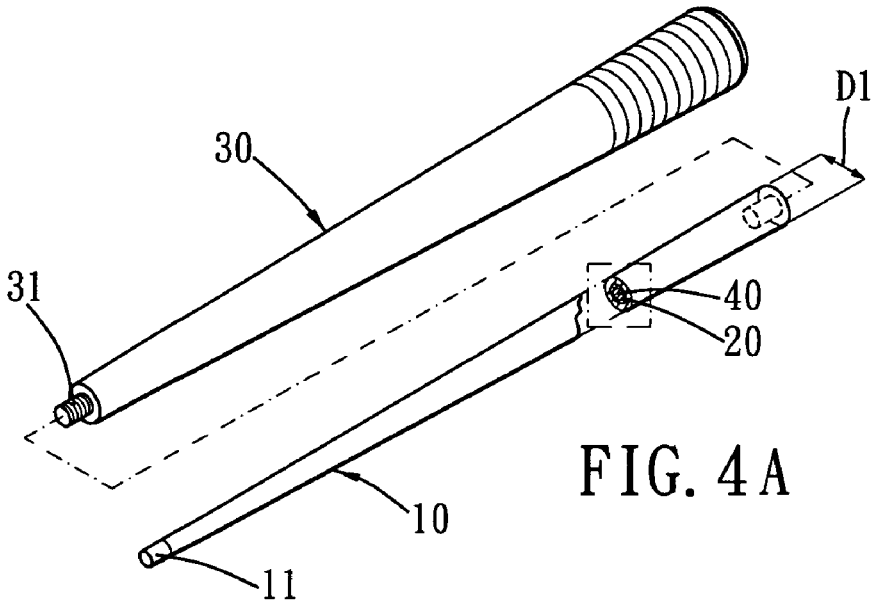
FIG. 4A is perspective view of the present invention.
Figure 4B:
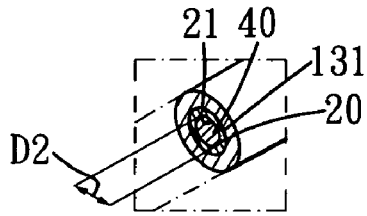
FIG. 4B is an enlarged view of a selected portion showing the inner structure of the present invention.
Figure 5:
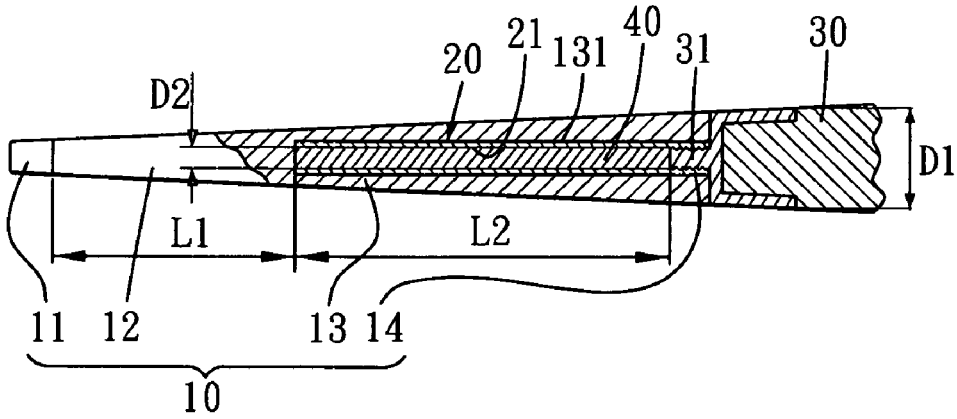
FIG. 5 is a partially cross-sectional view illustrating the inner structure of the present invention.

In addition, the shaft 10 is roughly a truncated conical structure and it has a rear end that has a first diameter D1 (as shown in FIG. 4A). The inner space 21 has a second inner diameter D2. Preferably, the second inner diameter D2 is between 25% and 35% of the first diameter D1. The best value is around 29%.

Besides, the ideal first length L1 is between 10% and 30% of the sum of the first length L1 and the second length L2.

Therefore, the improvements of the present invention can be summarized as follows.

[1] The weight and size are nearly same as the ones of a traditional solid wood cue stick. When the wooden fitting portion 40 fills the inner space 21 fully, the feeling of hollow structure is gone. The weight and size are nearly same as the ones of a traditional solid wood cue stick. Thus, the weight of the shaft 10 almost remains unchanged. Similarly, the balance point of this cue stick does not alter. The player can strike a cue ball as smooth as before.

[2] The total weight of the cue stick is proper. After the wooden fitting portion 40 fills the inner space 21 fully, the total weight of the cue stick becomes proper. When the player strikes a cue ball, the inertial force of this cue stick will not decrease. So, it is stable for controlling the cue ball.

[3] Its internal force transmission is evenly distributed. Due to the existence of the wooden fitting portion 40, when a force (or a counterforce) passes through the shaft 10, it will be divided into three paths, namely through the hollow portion 13, through the solid force-transmitting pipe 20, and through the wooden fitting portion 40. Therefore, the internal force transmission can be evenly distributed.

[4] The feedback feeling for striking the cue ball is excellent. Because the solid portion 12 is made by wood (such as maple, aspen, or the like), it has a proper stiffness with suitable flexibility (not too hard and not too soft). In addition, the total weight is proper. Thus, the feedback feeling for striking the cue ball is excellent (e.g., precise and consistent).

While this invention has been particularly shown and described with references to the preferred embodiments thereof, it will be understood by those skilled in the art that various changes or modifications can be made therein without departing from the scope of the invention by the appended claims.

What is claimed is:

1. A cue stick comprising:

a shaft having a tip formed on a distal end thereof and a connecting portion formed on a proximal end, said shaft having a solid portion adjacent said distal end and a hollow portion disposed between said solid portion and said connecting portion, said solid portion having a first length, said hollow portion having a deep hole extending between opposing ends thereof;

a solid force-transmitting pipe disposed in said deep hole, said solid force-transmitting pipe having a second length and an inner space defined by a bore formed axially therethrough, said solid force-transmitting pipe having two opposing ends, one end of said solid force-transmitting pipe being in contact with said solid portion and the opposing end extending to said connecting portion;

a butt having an engaging element formed on an end thereof for connecting with said connecting portion of said shaft, said engaging element contacting with said opposing end of said solid force-transmitting pipe; and a wooden fitting portion disposed in said inner space and having opposing ends being coterminous with said two opposing ends of said solid force-transmitting pipe, said wooden fitting portion having a first density, said solid portion of said shaft having a second density, said first density of said wooden fitting portion being between 80% and 120% of said second density of said solid portion.

2. The cue stick according to claim 1, wherein said shaft has a truncated conical contour with a rear end having a first diameter; said inner space having a second inner diameter; said second inner diameter being between 25% and 35% of said first diameter.

3. The cue stick according to claim 1, wherein said solid force-transmitting pipe is selected from carbon fiber or fiberglass.

4. The cue stick according to claim 1, wherein said first length is between 10% and 30% of a sum of said first length and said second length.

* * * * *